United States Patent [19]

Thornbloom

[11] 4,308,879

[45] Jan. 5, 1982

[54] COATING IMPLEMENT AND APPLICATOR

[76] Inventor: Leah L. Thornbloom, 7771 S. Harison Cir., Littleton, Colo. 80122

[21] Appl. No.: 185,984

[22] Filed: Sep. 10, 1980

[51] Int. Cl.[3] ..... A45D 40/30

[52] U.S. Cl. ..... 132/88.5

[58] Field of Search ..... 132/88.5, 88.7, 83

[56] References Cited

U.S. PATENT DOCUMENTS 2,323,595 7/1943 Hanisch ..... 132/88.7

2,811,768 11/1957 Axelson ..... 132/83 R

*Primary Examiner*—G. E. McNeill

*Attorney, Agent, or Firm*—Kyle W. Rost

[57] ABSTRACT

A longitudinally elongated casing is transversely divided into an applicator compartment and a carrier compartment at opposite longitudinal ends, and the casing is separable along a longitudinal division permitting opposite casing portions to be plugged together so that one portion serves as a handle extension for the other. The casing is preferred to be cylindrical with the longitudinal division following the cylinder axis for a majority of the casing length and then angling acutely away from the cylinder axis toward one end of the cylinder, whereby the end is unevenly divided in such a manner that when the cylinder portions are placed in tandem alignment the smaller end is receivable in the larger end. The applicator is contained in the applicator compartment of one cylinder portion by a snap fit, and the two cylinder portions are engageable in juxtaposed position by a hook at one end and a cap at the opposite end. Both the hooked end and the cap are domed and preferably semi-cylindrical.

15 Claims, 3 Drawing Figures

COATING IMPLEMENT AND APPLICATOR

FIELD OF THE INVENTION

The invention relates to coating implements with supply, and specifically to a supply container with independent applicator, especially to a tool supported out of communication with the supply. The invention also specifically relates to an applicator that includes a container closure. A further aspect of the invention is that the contriner may be assembled in a multiplicity of ways to also provide am elongated handle for the applicator.

DESCRIPTION OF THE PRIOR ART

Cosmetic or toiletry article cases and applicators are combined for convenience in carrying and use. Some cases employ a brush or sponge applicator that is carried in the case, while combinations are known in which the brush or sponge handle serves as a cover for the case, as taught in U.S. Pat. No. 3,760,820 to Seidler. Applicators are also known to be hinged to the carrier portion of a case in such a manner that the container serves as a handle to the applicator, as taught in U.S. Pat. No. 2,131,539 to Mureau.

Although such cases as mentioned above are known, new designs having expanded flexibility of use are desired, especially cases and applicators adapted for use with a variety of products and capable of applying such products with either sponge or brush.

SUMMARY OF THE INVENTION

An applicator with integral carrying case and handle extension is formed from a two part housing wherein each part is composed of a generally semi-cylindrical side wall with a quarter-spherical wall at one longitudinal end and having the semi-cylindrical portion of one of the housing parts become greater than semi-cylindrical with increasing closeness to the opposite longitudinal end thereof, while the other housing part correspondingly becomes less than semi-cylindrical, such that the two housing parts substantially maintain the configuration of a full cylinder with semi-spherical end when placed in mating relationship. The preferred casing is in the form of a cylinder axially split into top and bottom halves with the split line symmetrically dividing the halves at a diametric plane for a majority of the casing length but acutely angling away from the diametric plane and toward the outer wall of one casing half at the split line approaches one end of the cylinder, thereby defining a larger end in one half, such as the bottom half, while defining a smaller end on the opposite half, such as the top half. When the casing halves are united in cylindrical configuration, an applicator compartment is defined within the symmetrically divided end and a carrier compartment is defined at the unsymmetrically divided end. When the casing halves are divided, one half, such as the lower half, may retain the applicator in partially exposed position, and the smaller unsymmetrical end of one half may be received within the larger unsymmetrical end of the other half, thereby adding a handle extension to the half carrying the applicator.

The main object of the invention is to provide a carrying device of novel and attractive design that also is capable of unique interaction between halves of the device to provide an extension handle for an applicator portion on one end of the one half portion. In this way, the carrier is especially suited for use with body lotions, sun screens and like products that are applied to body areas not easily reached, such as the back.

A further object is to provide a carrier housing adaptable to use with either a brush or pad applicator and suited to contain any of a variety of cosmetic materials or toiletries.

These and other objects are achieved as more fully described in the following detailed description.

DESCRIPTION OF THE PREFERRED EMBODIMENT

Figures 1, 2, 3:
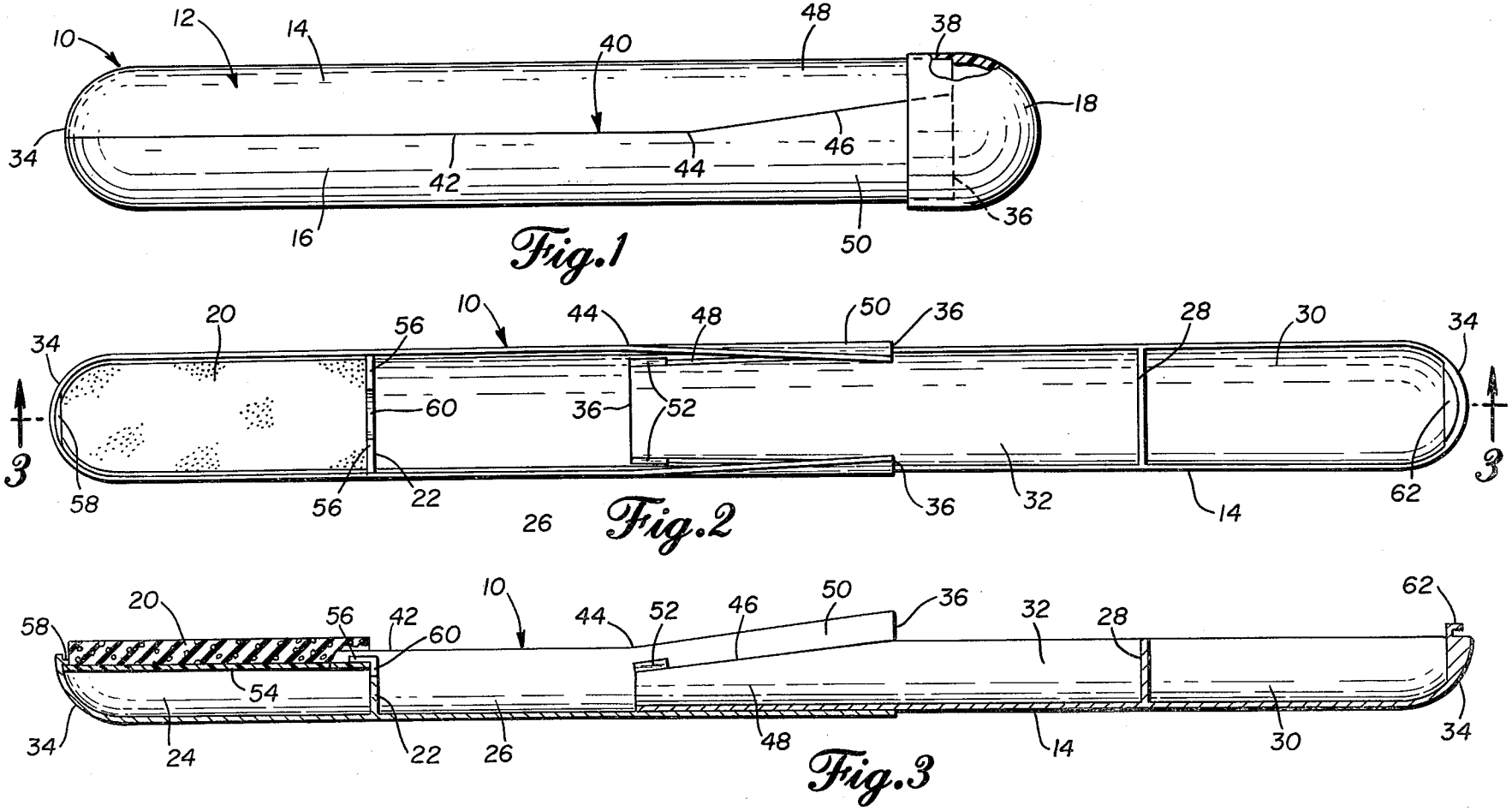
FIG. 1 is a side elevational view of the invention in partial section, showing the casing in assembled form as a carrier.
FIG. 2 is a top plan view of the invention, showing the casing in open form as an applicator and extension handle.
FIG. 3 is a cross-sectional view taken along the plane of line 3—3 of FIG. 2.

The coating implement 10 is a dual natured device as best shown by comparison of FIGS. 1–3, wherein the implement is shown to have two distinct ufnctional configurations, serving primarily as a carrier in FIG. 1 and serving primarily as an applicator in FIGS. 2 and 3. The component parts include a casing 12 constructed of two separable casing portions 14 and 16, optionally joined together in the embodiment of FIG. 1 by a cap means 18. Inside the casing and associated with one of the casing portions are an applicator means 20 and a dividing wall 22 defining the meeting of the applicator compartment 24 and the carrier compartment 26. The other casing portion may have a dividing wall 28 separating a cooperative applicator compartment 30 and carrier compartment 32.

Casing 12 is elongated along a longitudinal axis extending between the right and left ends of FIG. 1 and may be substantially symmetrical about this axis in the configuration of FIG. 1. The casing preferably is cylindrical for the majority of its length, although at the longitudinally opposite ends 34 and 36 the cylinder may terminate in any desired configuration. For example, end 34 is shown to be semi-spherical with the diameter of the sphere being identical to the cylinder base dimension. Opposite end 36, however, may be truncated normal to the longitudinal axis and closed by an independent cap 18 also of semi-spherical configuration with a suitable cylindrical flange 38 adapted to closely overlap the outer casing wall at end 36. Thus, the overall appearance of the casing in the closed configuration of FIG. 1 is that of a smooth cylinder with domed ends and as such is pleasing to the eye and to the touch.

The functional configuration of FIG. 1 is converted into the functional configuration of FIGS. 2 and 3 by opening the casing and reassembling the two portions 14 and 16 in longitudinal alignment. A separation line 40 longitudinally divides the casing 12 to thereby form the two portions 14 and 16. The casing is opened along line 40 and the two portions reassembled in any convenient manner such that one portion serves as a handle extension for the other. A preferred manner of dividing the casing is along a plane of symmetrical division of the cylindrical casing for a majority of the casing length, such as for two thirds of the length of the longitudinal axis starting at semi-spherical end 34. Separation line 40 therefore defines a first portion 42 corresponding to the intersection of a plane passing through the longitudinal axis of the cylinder with the wall of the cylinder. The separation line may deviate from symmetry at a point 44 near the cylinder end 36, wherein the plane defining line portion 42 angles acutely therefrom, such as at twenty degrees, to define line portion 46 extending from point 44 to end 36. Accordingly, the casing is divided into two unsymmetrical portions, which for the majority of their lengths adjacent end 34 constitute substantially equal halves, one of the equal halves having a smaller tail portion 48 while the other half has a larger tail portion 50.

As best shown in FIGS. 2 and 3, the two casing portions 14 and 16 may be reassembled for use as an applicator by inserting the smaller tail portion 48 into the larger tail portion 50 with the ends 36 of the two casing portion now facing in mutually opposite directions. Although both tail portion 48 and 50 may have an identical radius of curvature by virtue of being portions of the same cylinder, the relatively smaller arc of tail portion 48 at end 36 permits this tail portion to be received within the relatively larger arc of tail portion 50, and the larger arc of tail portion 50 serves the further function of retaining the smaller tail portion in tandem alignment. Further alignment retaining means such as ribs 52 on the inside face of tail portion 50 may engage the smaller tail portion 48 along separation line 46, which also defines an edge of portion 48.

One of the casing portions, for example portion 16, carries applicator means 20 near end 34. Suitable applicators include brush, sponge, or pad, the choice being dependent upon the intended use of the coating implement 10. A selection of applicators, optionally including all of the types above suggested, may be supplied with the implement, each applicator being mounted upon a backing plate 54 shaped to fit the longitudinal cross-section of the casing slightly offset from the central axis and longitudinally terminated remotely from casing end 34 at dividing wall 22. Thus, the backing plate 54 shown in FIG. 3 nests firmly in the applicator compartment 24 of casing portion 16 just below the separation line 42 and may be retained in this position by a snap fit. For example, the end of the plate 54 adjacent to wall 22 may be engaged under one or more ribs 56 extending toward end 34 from the top edge of wall 22, and the end of the plate adjacent casing end 34 may then snap under rib or boss 58 in the inner surface of the casing at end 34. A notch 60 defined centrally at the top edge of wall 22 provides a location for insertion of a tool to snap-out the backing plate 54 for replacement.

The other casing portion, such as portion 14, has a wall 28 spaced longitudinally from its respective section of end 34 by the same distance as wall 22. When the casing is in applicator configuration, this wall is near the terminal portion of the handle extension and acts as a bulkhead to retain the extension in semi-cylindrical configuration under pressure of a hand grip. An applicator compartment 30 cooperates with compartment 24 when the casing portions are in the assembled configuration of FIG. 1 to receive and protect the applicator means 20. Walls 28 and 22 cooperate to close the applicator compartment for further protection of the applicator means, while defining one end of the carrier compartment 26, 32, which is adapted to receive a bottle, tube or other container of material to be applied with the applicator means. Such container (not shown) is inserted through end 36, which is subsequently closed by cap 18 when the coating implement 10 is used as a carrier.

The two casing portions 14 and 16 are held together in the carrier configuration of FIG. 1 by retaining means that may be independent of the cap 18. For example, a snap catch best shown in FIGS. 2 and 3 may close the casing end 34, while cap 8 locks end 36. One such snap catch employs a hook 62 at end 34 of the handle extension. This hook may engage rib 58 of the applicator portion by slightly flexing the backing plate 54 to create sufficient engagement room.

The described coating implement is therefore capable of versatile use as a long-handled applicator with an easily replaced applicator head, while also serving as a convenient and attractive storage and carrying device for a selected preparation. While the above example has been described in considerable detail, the scope of the invention is not intended to be so limited, but should be interpreted in light of the following claims.

I claim:

1. A coating implement and applicator, comprising:

a longitudinally elongated casing defining therein an applicator compartment, said casing being separably longitudinally divided into first and second juxtaposed casing portions having a mutually non-symmetrical common end such that said common end of one casing portion is engageable in the common end of the other casing portion when said casing portions are placed in longitudinal tandem alignment; and applicator means carried by one of said casing portions in the applicator compartment portion thereof in position such that at least a portion of said applicator means is exposed from the applicator compartment portion when the casing portions are in longitudinal tandem alignment.

2. The coating implement and applicator of claim 1, wherein said casing comprises in longitudinal dimension a cylinder.

3. The coating implement and applicator of claim 2, wherein said casing comprises at an end opposite from said non-symmetrical common end a domed end.

4. The coating implement and applicator of claim 3, wherein said domed end is semi-spherical.

5. The coating implement and applicator of claim 1, further comprising cap means receivable over said non-symmetrical common end when the casing portions are in juxtaposed position.

6. The coating implement and applicator of claim 5, wherein said casing is cylindrical in longitudinal dimension and said cap means comprises a domed end and a cylindrical flange extending therefrom for engaging said cylindrical casing side.

7. The coating implement and applicator of claim 6, wherein said domed cap end is semi-spherical.

8. The coating implement and applicator of claim 2, wherein said first and second casing portions are each semi-cylindrical for at least a portion of their longitudinal dimension.

9. The coating implement and applicator of claim 2, wherein said casing is divided into first and second casing portions at least near one end thereof by a plane angled acutely to the longitudinal axis thereof.

10. The coating implement and applicator of claim 2, wherein said casing is divided into first and second casing portions near said non-symmetrical common end by a plane angling acutely to the casing longitudinal axis and entirely on one side thereof and is divided near the opposite end by a plane including said longitudinal axis, the two planes merging at a point intermediate the opposite ends of the casing.

11. The coating implement and applicator of claim 1, wherein said casing is divided into first and second casing portions near said non-symmetrical common end by a plane angled acutely to the longitudinal casing axis, and is divided near the opposite end by a plane parallel to said longitudinal axis, the two planes merging at a point intermediate the opposite ends of the casing.

12. The coating implement and applicator of claim 1, further comprising a transverse wall spaced from one end thereof and defining a carrier compartment on one side thereof closer to said non-symmetrical common end while defining said applicator compartment between the wall and the opposite end.

13. The coating implement and applicator of claim 12, wherein said first casing portion is connected to said transverse wall and said applicator means is carried by the transverse wall and first casing portion wall.

14. The coating implement and applicator of claim 13, wherein said applicator means comprises a backing plate; and further comprising releasable means for connecting the backing plate to the first casing portion.

15. The coating implement and applicator of claim 13, further comprising a bulkhead wall connected to said second casing portion at an axial position corresponding to that of said transverse wall, said transverse wall and bulkhead wall cooperatively defining the applicator compartment and carrier compartment, and the bulkhead wall resisting collapse of the second casing portion.

* * * * *